United States Patent [19]

Yamakawa

[11] Patent Number: 4,493,190

[45] Date of Patent: Jan. 15, 1985

[54] COOLING SYSTEM FOR AN ENGINE HAVING A PLURALITY OF ENGINE UNITS

[75] Inventor: Toru Yamakawa, Hachioji, Japan

[73] Assignee: Fuji Jukogyo Kabushiki Kaisha, Tokyo, Japan

[21] Appl. No.: 483,954

[22] PCT Filed: Jul. 30, 1982

[86] PCT No.: PCT/JP82/00296

§ 371 Date: Mar. 29, 1983

§ 102(e) Date: Mar. 29, 1983

[87] PCT Pub. No.: WO83/00528

PCT Pub. Date: Feb. 17, 1983

[30] Foreign Application Priority Data

Jul. 31, 1981 [JP] Japan ..... 56-121182

[51] Int. Cl.[3] ..... F02D 25/00; F02B 73/00

[52] U.S. Cl. ..... 60/714; 60/718; 123/11.1

[58] Field of Search ..... 60/714, 716, 718; 123/41.08, 41.09, 41.1, 41.01, 41.02, 41.29, 41.44, 41.51

[56] References Cited

U.S. PATENT DOCUMENTS

| | | | |
|---|---|---|---|
| 1,974,907 | 9/1934 | Worth | 60/714 |
| 3,949,556 | 4/1976 | Wallis | 60/718 |
| 4,312,304 | 1/1982 | Tyner | 123/41.31 |

FOREIGN PATENT DOCUMENTS

| | | | |
|---|---|---|---|
| 55-69719 | 5/1980 | Japan . | |
| 346756 | 4/1931 | United Kingdom | 60/714 |

*Primary Examiner*—William A. Cuchlinski, Jr.
*Attorney, Agent, or Firm*—Martin A. Farber

[57] ABSTRACT

In an engine comprising a primary engine unit 1 and an auxiliary engine unit 2, water jackets 44, 47 of the primary engine unit are connected to water jackets 46, 48 of the auxiliary engine unit and to a radiator 43 in series, and bypasses 52, 55 are connected to respective water jackets.

3 Claims, 6 Drawing Figures

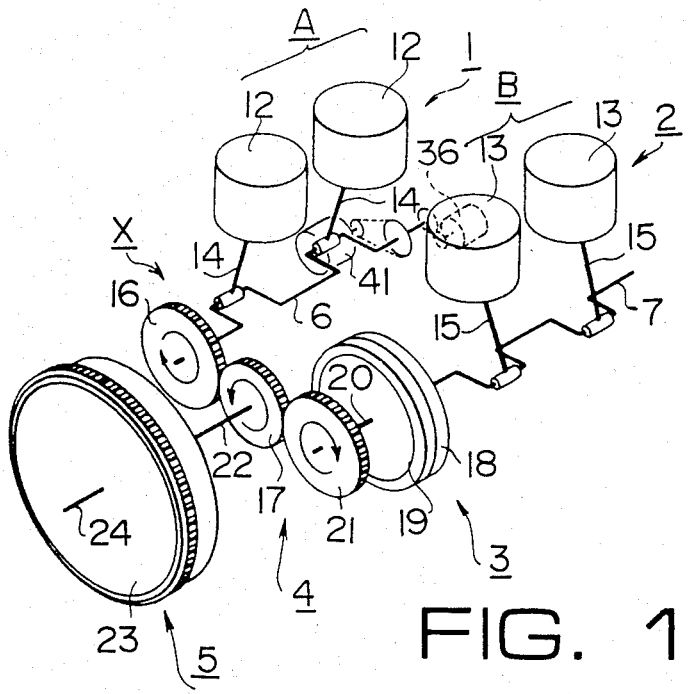
FIG. 1
FIG. 2
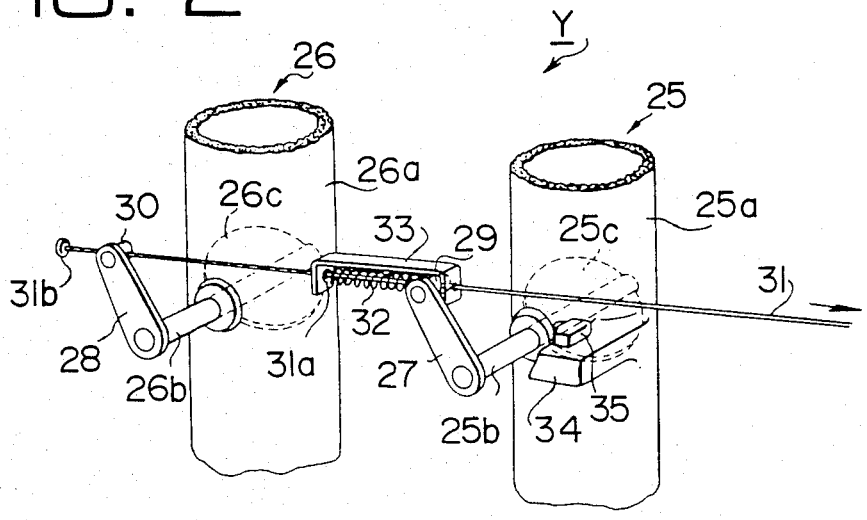

COOLING SYSTEM FOR AN ENGINE HAVING A PLURALITY OF ENGINE UNITS

TECHNICAL FIELD

The present invention relates to a cooling system for an engine comprising a plurality of engine units provided on a vehicle, the engine units of which are incorporated under preferable conditions in accordance with driving conditions of the vehicle.

BACKGROUND ART

Generally, the automotive vehicle is driven by a single internal combustion engine, and the cylinder volume of the internal combustion engine is constant during operation. Since low specific fuel consumption of the internal combustion engine is limited within a small range which is decided by engine torque and engine speed, and since the engine for automotive vehicles is operated under wide driving conditions, the fuel consumption characteristics is aggravated. In order to remove such disadvantages, there is provided an internal combustion engine comprising a plurality of engine units, which are incorporated in accordance with driving conditions of the vehicle for effectively generating a power, whereby fuel consumption characteristic may be improved. For example, Japanese patent publication No. 42-26050 discloses an internal combustion engine, in which a pair of engine units are disposed in parallel and powers of both units are transmitted to an output shaft. Each engine unit is controlled in accordance with load on the engine. However, the publication does not disclose a cooling system for such an engine.

DISCLOSURE OF THE INVENTION

The object of the present invention is to provide a cooling system in which water jackets of a primary engine unit are connected to water jackets of an auxiliary engine unit through a thermostat whereby the auxiliary engine unit can be warmed up when the temperature of the coolant exceeds a predetermined value, and at the same time the load on the radiator of the vehicle can be lightened by decreasing of the temperature of the coolant due to the heat absorption of the auxiliary engine.

BRIEF DESCRIPTION OF THE DRAWINGS

FIG. 1 is a schematic perspective view of an engine according to the present invention, FIG. 2 is a schematic perspective view of a carburetor assembly and a throttle valve operating device;

BEST MODE FOR EMBODYING THE INVENTION

Figure 3:
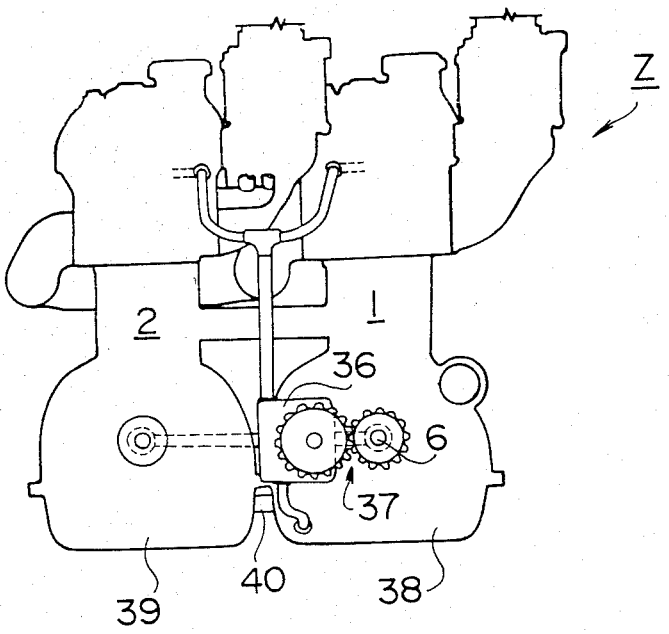
FIG. 3 is a schematic illustration showing a lubricating system.

Referring to FIGS. 1 to 6, the engine comprises engine units A and B, a power transmission system X, a throttle valve control system Y, a lubricating system Z, and a cooling system W of the present invention. The engine units A and B comprise a primary engine unit 1 and an auxiliary engine unit 2, and the power transmission system comprises a clutch portion 3, an output shaft portion 4 and a flywheel portion 5. Each of engine units 1 and 2 comprises an independent two-cylinder engine having an independent ignition system. The primary engine unit 1 comprises a pair of pistons 12 connected to a crankshaft 6 by connecting rods 14, and the auxiliary engine unit 2 comprises a pair of pistons 13 connected to a crankshaft 7 by connecting rods 15. A gear 16 is securely mounted on the crankshaft 6. The crankshaft 7 is connected to a shaft 20 through an electromagnetic powder clutch comprising a driving member 18 and driven member 19. A gear 21 secured to the shaft 20 engages with an output gear 17 which engages with the gear 16. An output shaft 22 of the output gear 17 is secured to a flywheel 23 including a clutch which couples the output shaft 22 with an input shaft 24 of a transmission (not shown).

In operation, when a starter is operated, the primary engine unit 1 is started. At that time, since no signal is fed to the electromagnetic powder clutch 3, the clutch 3 is disengaged.

During low engine torque operation, the electromagnetic clutch 3 is disengaged and the fuel consumption is low.

In a high engine torque operation, a control signal is generated to engage the clutch 3. Thus, the auxiliary engine unit 2 is started and output thereof is transmitted to the output shaft 22.

The control signal for controlling the electromagnetic powder clutch 3 is produced by the throttle valve control system Y shown in FIG. 2.

Referring to FIG. 2, carburetors 25 and 26 comprise barrels 25*a* and 26*b*, throttle valves 25*c* and 26*c* supported by throttle shafts 25*b* and 26*b*, respectively. Levers 27 and 28 secured to throttle shafts 25*b*, 26*b* have pins 29 and 30 having holes, respectively, through which an accelerator wire 31 passes. Engaging members 31*a* and 31*b* are fixed to the accelerator wire 31. A compression spring 32 is provided between the pin 29 and the engaging member 31*a*. The engaging member 31*a* is slidably engaged with the wire 31 and the other end of a frame 33 is also slidably engaged with the wire 31 adjacent to the pin 29. A microswitch 35 is provided on a support 34 so as to be operated by the lever 27.

In a small engine torque operation, when the accelerator pedal is depressed, the accelerator wire 31 moves to the right in FIG. 2. Since the engaging member 31*a* engages with the lever 27 through the spring 32 and the engaging member 31*b* does not engage with the lever 28, only the primary engine unit 1 is accelerated or decelerated.

In a large engine torque operation, the accelerator pedal is deeply depressed, so that the lever 27 engages with the microswitch 35 to close the circuit of the electromagnetic powder clutch 3. Thus, the electromagnetic powder clutch is engaged, so that the crankshaft 7 of the auxiliary engine unit 2 is coupled to the shaft 20. At that time, the throttle valve 25*c* is at an immediately before the full open position. Thereafter, the lever 27 abuts on the support 34, on the other hand, the engaging member 31*b* engages the lever 28. When the accelerator pedal is further depressed, the spring 32 is compressed by the engaging member 31*a* and the lever 28 is rotated by the engaging member 31*b*. Thus, the auxiliary engine unit 2 is accelerated, so that composite power of the both engine units is produced.

When the accelerator pedal is released, the accelerator wire 31 moves to the left, so that the lever 28 rotates in the counterclockwise direction and then the lever 27 also rotates in the same direction. Thus, the microswitch 35 is opened, the electromagnetic powder clutch 3 is disengaged, and only the primary engine unit 1 is operated.

Referring to FIG. 3 showing a lubricating system, an oil pump 36 is driven by the crankshaft 6 through a gear train 37. The lubricating oil is picked up from an oil pan 38, which is communicated with an oil pan 39 through a passage 40, and sent to bearings for the crankshafts, valve mechanisms and others.

Figure 4:
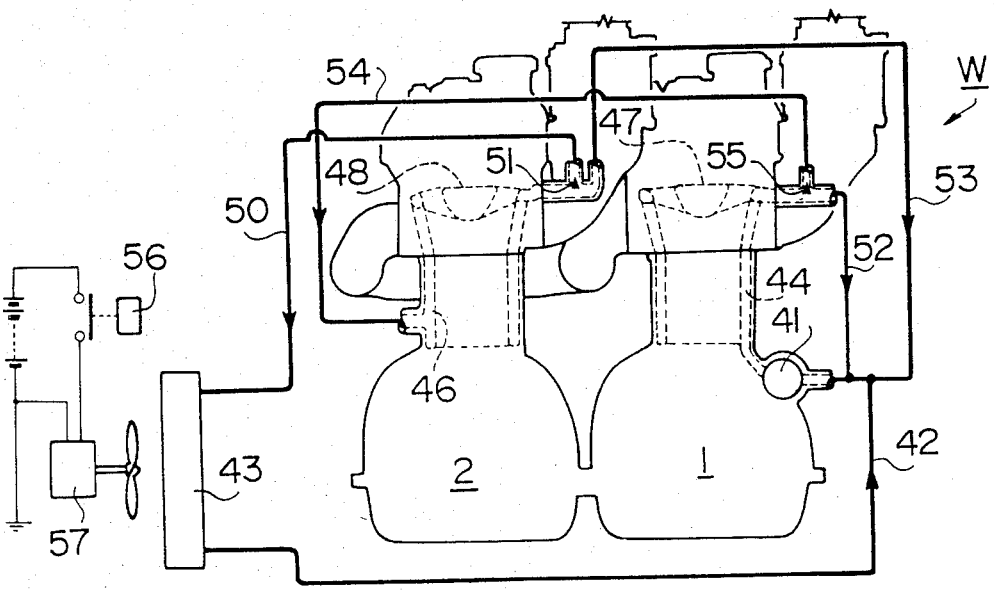
FIG. 4 is a schematic illustration showing a cooling system of the present invention.

Referring to FIG. 4 showing a cooling system of the present invention, a water pump 41 is attached to the primary engine unit 1 so as to be driven by the engine unit. A lower hose 42 of a radiator 43 is connected to an inlet of the water pump 41 and an outlet of the water pump 41 is communicated with water jackets 44 of the primary engine unit 1. The water jackets 44 are connected in series to water jackets 46 of the auxiliary engine unit 2 through water jackets 47, a thermostat 55, and a passage 54. The water jackets 46 are communicated with the radiator 43 through water jackets 48, a thermostat 51, and an upper hose 50. On the other hand, the water jackets 44 are connected to the inlet of the water pump 41 through a bypass passage 52, and water jackets 46 are communicated with the inlet through a bypass 53. In the system, pipeline resistance of bypass 52 is larger than that of the passage connecting passage 54, water jackets 46 and passage 53.

When the primary engine unit 1 is operated and the temperature of the coolant in the cooling system is low, valves in thermostats 51 and 55 are closed. Accordingly, the coolant flows through water jackets 44, water jackets 47 in a cylinder head of the engine and bypass 52. When the primary engine unit 1 is warmed up, the valve of thermostat 55 is opened. Since the pipeline resistance of the bypass 52 is larger than the passage comprising the passages 54 and 53, the coolant flows through water jackets 44, 47, passage 54, water jackets 46, 48 and passage 53. Thus, the coolant flows through the auxiliary engine unit 2, thereby to warm up the engine unit. At the same time, since the amount of coolant circulated in the coolant circuit increases, cooling effect on the primary engine unit is heightened. When the temperature of the coolant exceeds a predetermined value, the valve in the thermostat 51 opens, so that the coolant flows through the radiator 43. When the temperature of the coolant passing the radiator 43 exceeds a predetermined value, a thermosensor 56 operates to actuate a fan 57 to cool the coolant. The pipeline resistance of the passage 53 is larger than that of the passage comprising the hoses 50 and 42 and the radiator 43. Therefore, the coolant flows mainly through the radiator 43.

Figure 5:
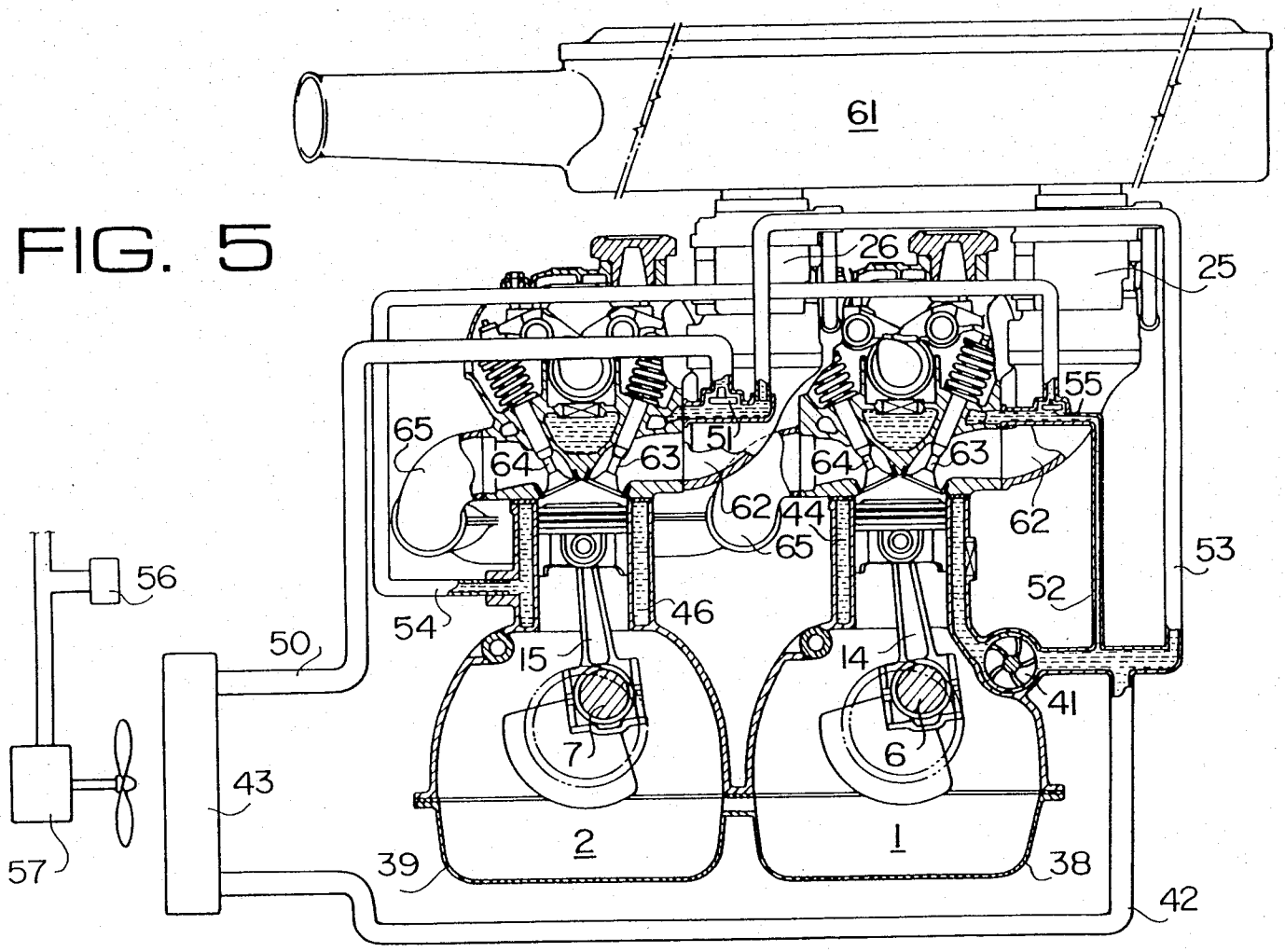
FIG. 5 is a sectional front view of the engine.
Figure 6:
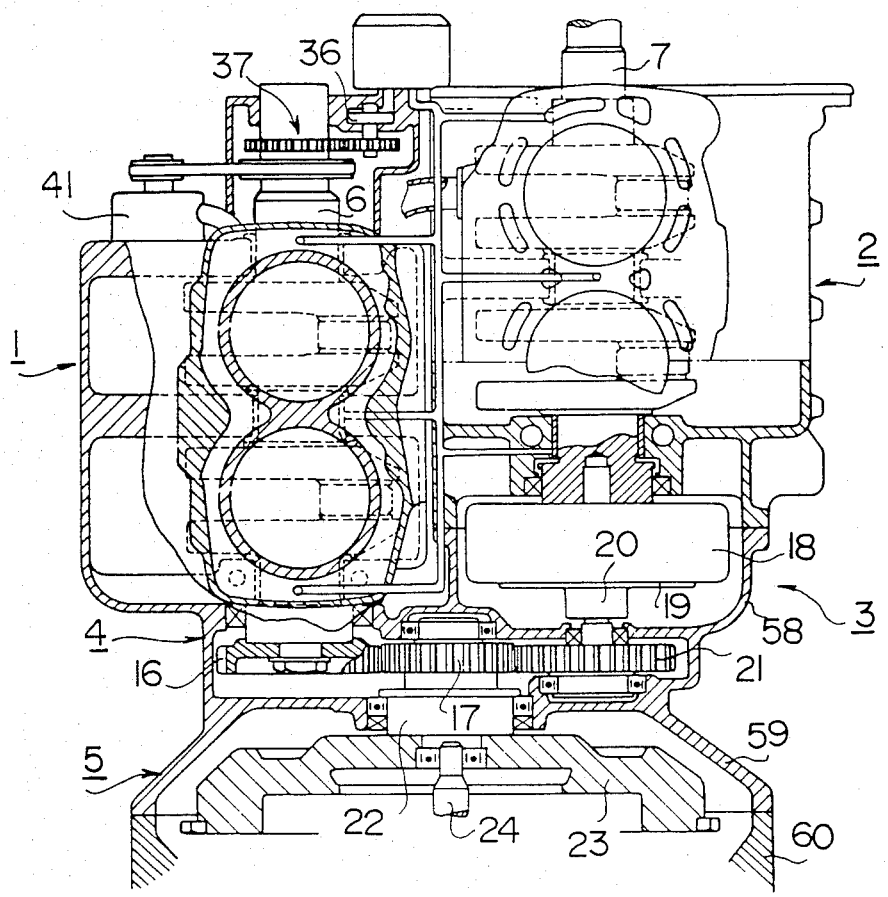
FIG. 6 is a plan view of the engine shown partly in section.

Referring to FIGS. 5 and 6, the primary engine unit 1 and auxiliary engine unit 2 are arranged side by side and cylinder blocks, crankcases and others are integrally assembled. A casing 58 for the clutch portion 3 and a casing 59 for the flywheel portion 5 are formed in one piece construction and secured to a casing 60 of the transmission. In FIG. 5, an air cleaner 61, intake manifolds 62, intake valves 63, exhaust valves 64, and exhaust pipes 65 are depicted.

PROBABILITY OF INDUSTRIAL EXPLOITATION

The present invention is characterized, as described above, in that the cooling system comprises a water pump is connected to water jackets of the primary engine unit, water jackets of the auxiliary engine unit are connected to water jackets of the primary engine unit in series, a radiator is connected to water jackets of the auxiliary engine unit in series, a bypass is provided to connect each water jacket to the water pump, means is provided to change the coolant circuit in dependency on the temperature of the coolant.

Therefore, the coolant flows through the auxiliary engine unit after warm up of the primary engine unit, so that the former engine unit can be warmed up thereby to improve the starting operation of the engine, and the frequency of operating of the radiator fan may be decreased, since the temperature of the coolant is kept low by the auxiliary engine.

I claim:

1. A cooling system for an internal combustion engine for a vehicle comprising a plurality of independent engine units including a primary engine unit and at least one auxiliary engine unit, an output shaft, a clutch for transmitting the output of said auxiliary engine unit to said output shaft in dependency on operational conditions, characterized in that a water pump is connected to water jackets of said primary engine unit, water jackets of said auxiliary engine unit are connected to water jackets of said primary engine unit in series, a radiator is connected to water jackets of said auxiliary engine unit in series, a bypass is provided to connect each water jacket to the water pump, means is provided to change the coolant circuit in dependency on the temperature of the coolant.

2. The cooling system according to claim 1, wherein said means are thermostats operated by the temperature of the coolant.

3. The cooling system according to claim 1 further comprising thermostats operable to flow the coolant through only said primary engine unit when the temperature of the coolant is lower than a predetermined value.

* * * * *